United States Patent [19]

Meyrin

[11] 4,072,124

[45] Feb. 7, 1978

[54] NAUTICAL VEHICLE

[75] Inventor: Paul Meyrin, Lausanne, Switzerland

[73] Assignee: Gemeines Forchungsinstitut Anstalt, Liechtenstein, Liechtenstein

[21] Appl. No.: 621,790

[22] Filed: Oct. 14, 1975

[51] Int. Cl.[2] ..... B63H 1/38; B63H 16/12

[52] U.S. Cl. ..... 115/19; 115/2; 115/23; 115/25

[58] Field of Search ..... 115/1 R, 2, .5 A, 19, 115/23, 25, 26, 49, 50; 188/16; 180/6.2

[56] References Cited

U.S. PATENT DOCUMENTS

| | | | |
|---|---|---|---|
| 2,323,261 | 6/1943 | Vigo | 115/2 |
| 2,347,241 | 4/1944 | Boldt | 188/16 |
| 3,664,290 | 5/1972 | Finn | 115/1 R |
| 3,965,843 | 6/1976 | Smith | 115/.5 A X |

*Primary Examiner*—Stephen G. Kunin
*Assistant Examiner*—Gregory W. O'Connor
*Attorney, Agent, or Firm*—Bucknam and Archer

[57] ABSTRACT

A nautical vehicle comprising at least one pedal system, adapted to be operated by at least one user to drive inflatable wheels providing the floatation, propulsion and direction of the vehicle, preferably it further comprises a differential gear for transmitting a rotating movement from the pedal driving system to at least two wheels mounted on either side of the vehicle respectively, and devices for separately braking of the two wheels.

4 Claims, 2 Drawing Figures

NAUTICAL VEHICLE

The present invention relates to nautical vehicles designed for operating with no engine and intended for aquatic sports or pleasure navigation in particular, while being however suitable for many other uses, e.g. as general-purpose transport vehicles.

One object of the invention is to take advantage of the user's own strength with the highest possible efficiency, by allowing the vehicle to operate without any so-called "negative" wetted surfaces, viz. surfaces not adapted to promote propulsion.

More specifically, the present invention relates to a vehicle comprising means for enabling at least one user, in particular through a pedal system, to drive inflatable wheels capable of providing the floatation, the propulsion and the direction of said vehicle, preferably exclusive of any so-called "negative" wetted surfaces.

Said vehicle preferably comprises a differential gear for transmitting a rotating movement of said driving means to at least two wheels mounted on either side of the vehicle, respectively, and means for separately braking each of said two wheels. Said wheels are, preferably, four in number and coupled by pairs on either side, so that, on each side, the front wheel and the associated rear wheel always rotate at the same speed. Preferably, the braking means are controlled by a single handwheel, the direction of rotation of which determines which side of the vehicle is submitted to a braking action.

According to a further feature of the invention, the outer cover of each inflatable wheel is provided with a plurality of ribs parallel to the axis of the respective wheel and evenly distributed about the cover periphery, as well as with at least one circular rib located in a transverse cross-sectional plane at right angles to said wheel axis, i.e. preferably two circular ribs located along either outer edge of the cover. In operation, those ribs parallel to the wheel axis have a propulsive action, whereas the circular ribs have an anti-drift effect.

Figure 1:
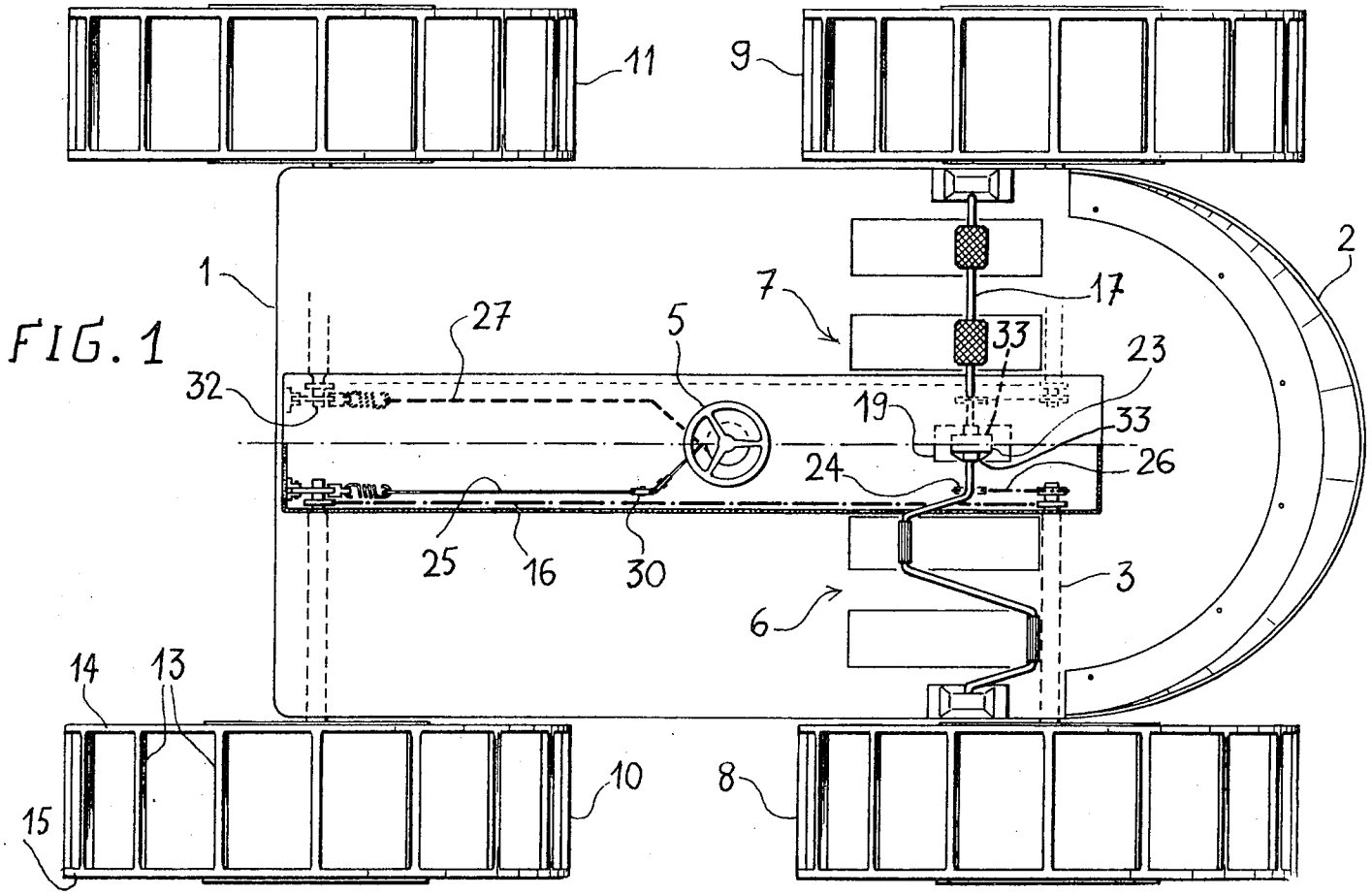
Figure 2:
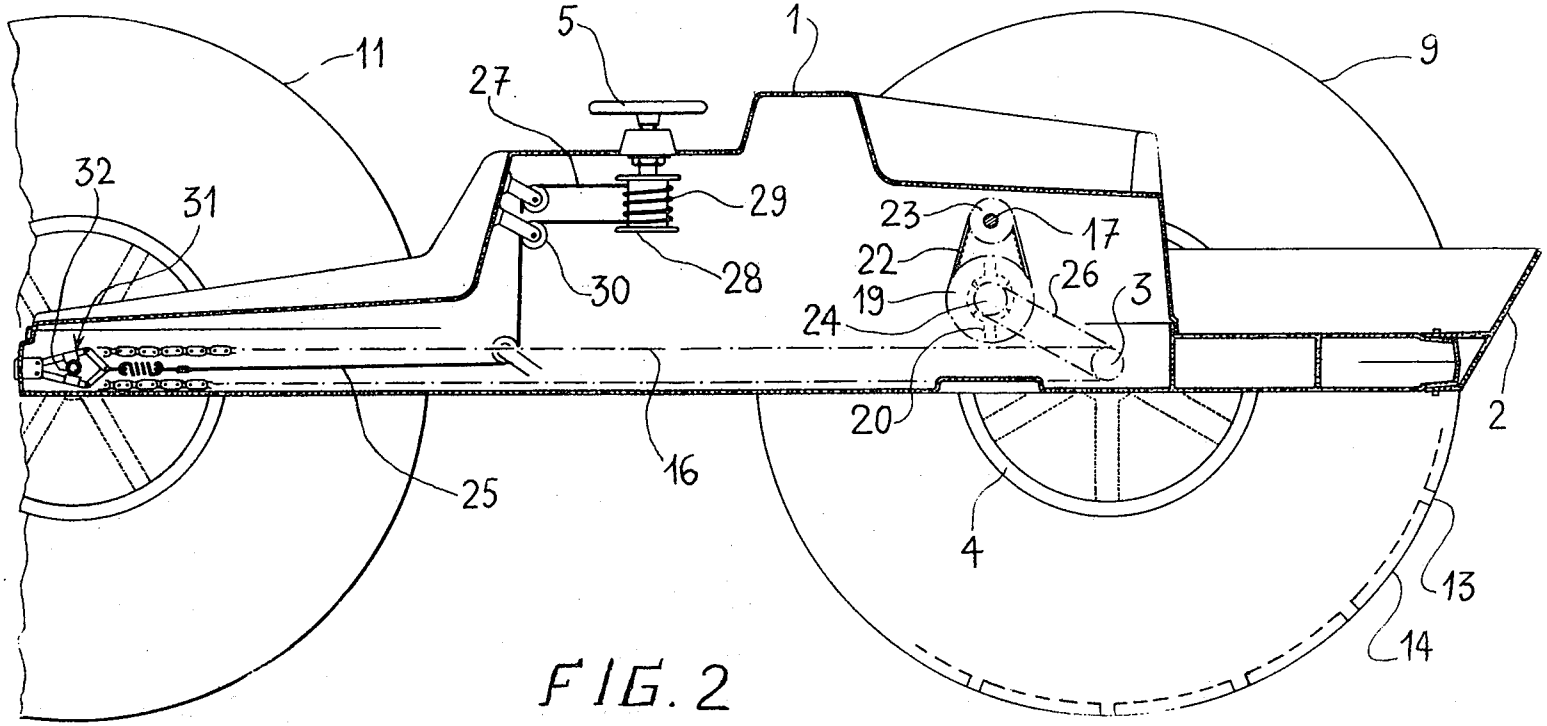

A preferred embodiment of the invention will be described hereunder, with reference to FIGS. 1 and 2 which represent the vehicle in top plane view and in side view, partly in cross-section.

As shown on these figures, hull I, which is light and made of plastic material, carries a breakwater device 2 in its front-portion and two seats not represented for two users sitting side-by-side in front of a hand-wheel 5 and pedal systems 6,7.

Onto said hull are mounted four inflatable wheels 8,9,10 and 11 whose portions in contact with water are, in operation, the only wetted surfaces of the vehicle, these wetted surfaces being "positive", i.e. adapted to promote propulsion.

Each wheel comprises an outer cover of canvas coated with rubber or polyvinyl chloride mounted on a rim 4 made of glass-fiber reinforced plastic, and its airtightness is achieved by means of an inner tube. The outer face of said cover is provided, on the one hand, with a series of ribs 13, all of which are parallel to the axis of the respective wheel and which are intended to promote propulsion through rotation, and, on the other hand, with two circular ribs 14, 15, located along either edge of the cover.

The wheels are coupled by pairs, viz. each front wheel (8 or 9) is coupled with the rear wheel (10 or 11) located on the same side of the vehicle, by means of a chain 16. For ensuring the vehicle propulsion, a rotating movement is transmitted from the pedal systems to the front wheels through a differential gear whereas braking actions for generating direction changes are exerted upon the rear wheels.

The differential gear is located inside the hull 1 and of conventional construction, such as described in "The Machine Tool — An International Dictionary of Basic Concepts — Eugene Wüster — ref.508", although in the device of the invention the differential gear comprises two opposite spider gears. The crown-wheel 19, carrying the axles of the two spider gears such as 20, is rotatively mounted on the hull 1 about an axis perpendicular to the axes of the spider gears (and perpendicular to the plane of FIG. 2). It is driven, through an outer cogged belt 22, by a sprocket-wheel 23 coupled with the two shafts carrying the pedals (said pedals are directed at right-angles to one another) of pedal systems 6,7 and driven by the latter. The two planet gears 33 are mounted on axles 24 which, in turn, drive the axles 3 of wheels 8,9 respectively, through cogged belts 26. The differential gear mechanism operates by making the driven wheels integral with gears 31 which are called planet gears. The planet gears engage with spider gears 20. The axles of the spider gears are carried by crown wheel 19. Each cogged belt cooperates with teeth-wheels, integral with the axle 3 of the wheel and with the axle 24 of the planet gear 33.

Hand-wheel 5 provides the control of rotation.

It is integral with a grooved drum 28 about which is wound a cable 29, the two end parts 25 and 27 of which are guided by means of pulleys such as 30 up to each rear wheel respectively and are respectively fastened at an apex of a deformable quadrilateral polygon 31 (made of four articulated links) acting as a brake by bringing two shoes, or skids, to bear on axle 32 of the respective wheel, when a pulling action is exerted along the respective end part of the cable. Depending on the direction of rotation imparted to hand-wheel 5, the braking action will be exerted either on one or the other of wheels 10 and 11. The cable is so connected to the brakes that braking on the starboard wheels is obtained by rotating the handwheel clockwise. Such a braking effect, in connection with the differential gear, permits to achieve a speed difference between the wheels on one side of the vehicle and those on the other side, thus allowing to steer the vehicle both in a gradual and very accurate way.

Of course, the invention is not restricted to the specific preferred embodiment described. For example, a bar or tiller could be used in place of wheel 5 to control the cable to operate the brakes.

What we claim is:

1. A nautical vehicle adapted to be operated by at least one user, comprising two identical sets of at least one inflatable wheel on each side of said vehicle, driving means comprising a pedal-like system and means for transmitting the motion of the pedal system to all of said wheels, and steering means comprising essentially means for selective braking of one set of said wheels and wherein said driving means comprises a differential gear comprising an input shaft coupled to said pedal-like system and two output shafts respectively coupled to said two sets of wheels.

2. A vehicle according to claim 1 wherein said steering means comprises a single hand-wheel, means for connecting said hand wheel to said set of wheels, the direction of rotation of said hand wheel determining the set of wheels on which a braking action is applied.

3. A vehicle according to claim 2 wherein said means for connecting said hand wheel to said wheels comprise a cable.

4. A vehicle according to claim 3 wherein each set of wheels comprises a front wheel and a rear wheel.

* * * * *